US009580227B2

(12) United States Patent
Wood

(10) Patent No.: US 9,580,227 B2
(45) Date of Patent: Feb. 28, 2017

(54) BABY BOTTLE

(71) Applicant: Zak Wood, Santa Monica, CA (US)

(72) Inventor: Zak Wood, Santa Monica, CA (US)

( * ) Notice: Subject to any disclaimer, the term of this patent is extended or adjusted under 35 U.S.C. 154(b) by 135 days.

(21) Appl. No.: 14/532,009

(22) Filed: Nov. 4, 2014

(65) Prior Publication Data

US 2016/0120761 A1 May 5, 2016

(51) Int. Cl.

| | |
|---|---|
| ***A61J 9/08*** | (2006.01) |
| ***B65D 81/32*** | (2006.01) |
| ***A61J 9/00*** | (2006.01) |
| ***A61J 11/00*** | (2006.01) |

(52) U.S. Cl.

CPC ..... *B65D 81/3266* (2013.01); *A61J 9/008* (2013.01); *A61J 11/008* (2013.01)

(58) Field of Classification Search

CPC ..... B65D 81/3266; A61J 9/008; A61J 11/008
See application file for complete search history.

(56) References Cited

U.S. PATENT DOCUMENTS

| | | | | |
|---|---|---|---|---|
| 2,889,064 | A * | 6/1959 | Kurkjian | A61J 11/02 215/11.1 |
| 4,613,050 | A * | 9/1986 | Atkin | A61J 9/00 215/11.5 |
| 5,419,445 | A * | 5/1995 | Kaesemeyer | A61J 1/2093 206/220 |
| 5,634,714 | A | 6/1997 | Guild | |
| 5,779,071 | A | 7/1998 | Brown et al. | |
| 5,794,802 | A | 8/1998 | Caola | |
| 6,042,850 | A * | 3/2000 | Ida | A61J 9/001 215/11.1 |
| 6,045,254 | A | 4/2000 | Inbar et al. | |
| 6,257,428 | B1 | 7/2001 | Caola | |
| 7,331,478 | B2 | 2/2008 | Aljadi | |
| 7,484,633 | B1 | 2/2009 | Moher | |
| 7,537,128 | B2 | 5/2009 | Nachumi | |
| 7,546,919 | B2 | 6/2009 | Lee | |
| 7,810,661 | B2 * | 10/2010 | Murphy | A61J 9/00 206/219 |
| 7,850,027 | B2 | 12/2010 | Hayes et al. | |
| 8,371,440 | B2 | 2/2013 | Questad | |
| 8,413,803 | B2 | 4/2013 | Questad | |
| 8,439,231 | B2 * | 5/2013 | Schroedter | B65B 1/36 222/153.13 |
| 8,459,450 | B1 | 6/2013 | Whitaker et al. | |
| 8,556,094 | B2 | 10/2013 | Brown et al. | |
| 8,573,421 | B2 | 11/2013 | Py et al. | |
| 2004/0118801 | A1 | 6/2004 | Brown et al. | |
| 2005/0056608 | A1 | 3/2005 | Nesin | |
| 2007/0102388 | A1 | 5/2007 | Lewis et al. | |
| 2009/0178940 | A1 | 7/2009 | Said | |
| 2009/0301904 | A1 | 12/2009 | Bullard | |
| 2010/0213085 | A1 | 8/2010 | Belnap | |
| 2014/0102918 | A1 * | 4/2014 | Eitrheim | A61J 1/2093 206/219 |
| 2014/0102919 | A1 | 4/2014 | Gutierrez | |

* cited by examiner

*Primary Examiner* — Tri Mai

(57) ABSTRACT

A baby bottle for feeding an infant is adapted to store baby formula powder in a nipple cavity separated from fluid in the bottle by a seal plate. The seal plate is dislodged by manual pressure applied to at least one seal plate release button integrated into a collar of the baby bottle, to permit the formula powder to mix with the fluid when the bottle is to be used for feeding.

20 Claims, 12 Drawing Sheets

BABY BOTTLE

RELATED APPLICATIONS

This is the first application filed for this invention.

FIELD OF THE INVENTION

This invention relates in general to nursing bottles for infants and, in particular, to a baby bottle for feeding infants that is adapted to store fluid such as water and baby formula powder in separate compartments until feeding time.

BACKGROUND OF THE INVENTION

Many infants require bottle feeding because they cannot be breastfed, require supplemental nutrition, or due to parental choice. Consequently, many designs and configurations for baby bottles have been invented. Some of the bottles are designed to store baby formula powder and fluid such as water separately so that a need to hand mix baby formula in a challenging environment or a need to refrigerate, then reheat, pre-mixed baby formula is avoided. A baby bottle that stores baby formula powder and fluid such as water separately is convenient and advantageous in many instances. For example it: greatly ameliorates the often challenging and time consuming task of preparing baby formula for consumption when traveling or when outside the home; simplifies supplying infant nutrition at daycare; permits preparation ahead of time for a busy day at or away from home; and greatly reduces the time required to prepare mixed formula. This convenience should also extend to assembling a bottle prior to use and cleaning the bottle after use. In addition, some baby bottles tend to leak if they are tipped over or jostled about in a carrier bag or the like, which can be frustrating and inconvenient.

SUMMARY OF THE INVENTION

It is therefore an object of the invention to provide a baby bottle designed for everyday use that stores baby formula powder and fluid such as water separately, is easy to clean, stays hygienic, is simple to assemble, will not leak prior to being readied for use, and makes it easy to prepare mixed formula on an as needed basis.

The invention therefore provides a baby bottle, comprising: a bottle adapted to store a predetermined volume of fluid, the bottle having a top end with a wide mouth and an external thread around the wide mouth; a nipple adapted to store a predetermined volume of baby formula powder for mixing with the fluid, the nipple having a bottom end adapted to cover the wide mouth of the bottle; a collar element that accepts the nipple, the collar element having at least one seal plate release mechanism to release the stored baby formula powder into the stored fluid, and an internal thread designed to engage the bottle's external thread; a seal plate adapted to be retained by the nipple, providing a fluid resistant partition between the fluid and the baby formula powder; and a snap-on cap that attaches to the collar to keep an exposed portion of the nipple hygienic prior to use.

The invention further provides a baby bottle, comprising: a bottle adapted to store a predetermined volume of fluid, the bottle having a wide mouth with an external thread around the wide mouth; a nipple adapted to store a predetermined volume of baby formula powder for mixing with the fluid, the nipple having a bottom end adapted to cover the wide mouth of the bottle; a collar element that accepts the nipple, the collar element having opposed seal plate release mechanisms adapted to release the stored baby formula powder into the stored fluid, and an internal thread adapted to engage the external thread of the bottle; and a seal plate adapted to be releasably retained within a seal plate recess of the nipple, the seal plate providing a fluid resistant partition between the fluid and the baby formula powder.

The invention yet further provides a baby bottle, comprising: a bottle adapted to store a predetermined volume of fluid, the bottle having a wide mouth with an external thread around the wide mouth; a nipple adapted to store a predetermined volume of baby formula powder for mixing with the fluid, the nipple having a bottom end adapted to cover the wide mouth of the bottle; a collar element that accepts the nipple, the collar element having a seal plate release mechanism adapted to release the stored baby formula powder into the stored fluid, and an internal thread adapted to engage the external thread of the bottle; a seal plate adapted to be releasably retained within a seal recess of the nipple, the seal plate providing a fluid resistant partition between the fluid and the baby formula powder; and at least one vent system that inhibits an egress of fluid from the bottle while permitting air to flow into the bottle when a vacuum is created within the bottle.

BRIEF DESCRIPTION OF THE DRAWINGS

Having thus generally described the nature of the invention, reference will now be made to the accompanying drawings, in which.

DETAILED DESCRIPTION OF THE PREFERRED EMBODIMENTS

The invention provides a baby bottle having: a bottle adapted to store a fluid such as water; a pliable breast shaped nipple with a nipple cavity adapted to store baby formula powder until feeding time; a collar which accepts the nipple and includes integrated seal plate release mechanisms; a seal plate which retains baby formula powder in the nipple cavity and maintains a fluid tight seal between the baby formula powder and fluid stored in the bottle; and a cap that protects the nipple when the bottle is not in use for feeding an infant. Opposing seal plate release mechanisms, integrated in the collar, are pressed by a user at feeding time, thereby dislodging the seal plate and releasing baby formula powder into the fluid stored in the bottle. The user then shakes the bottle to mix the formula and serves the prepared baby formula to the infant.

Figure 1:
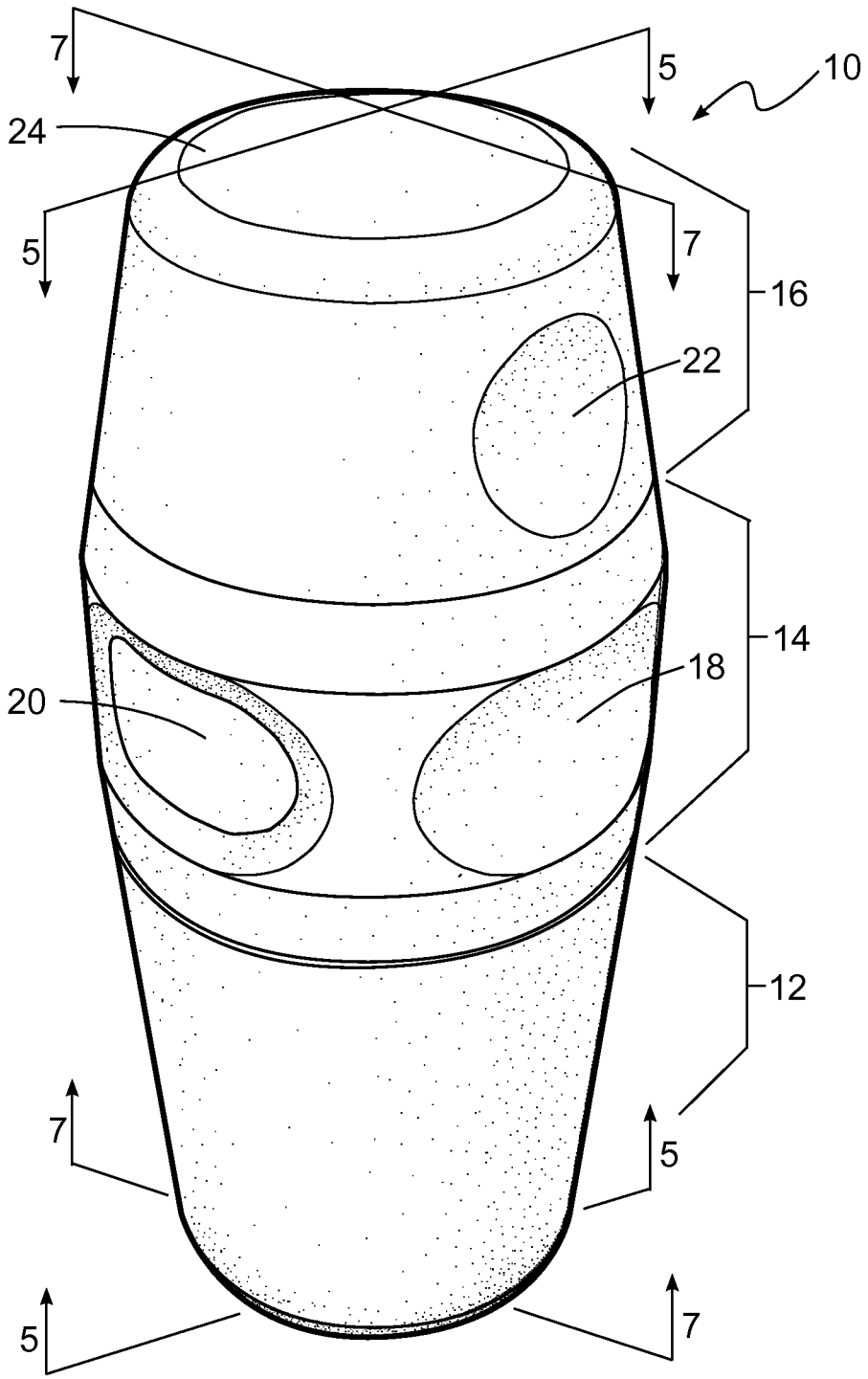
FIG. 1 is a perspective view of one embodiment of a baby bottle in accordance with the invention.

FIG. 1 is a perspective view of one embodiment of a baby bottle 10 in accordance with the invention. The following components are visible when the baby bottle 10 is fully assembled: a bottle portion 12, hereinafter referred to simply as bottle 12; a collar portion 14, hereinafter referred to simply as collar 14; and a bottle cap 16, hereinafter referred to simply as cap 16.

As seen in FIG. 1, the collar 14 has integrated opposing seal plate release mechanisms 20 (only one can be seen) and integrated opposing surface grips 18 (only one can be seen), hereinafter referred to as grips 18. The snap-on cap 16 has a concave surface 22 to provide improved manual leverage when removing the cap 16 from the baby bottle 10. The cap 16 has a flat top 24 which supports the baby bottle 10 in a stable inverted position when the baby bottle 10 is placed upside down on a flat surface.

Figure 2:
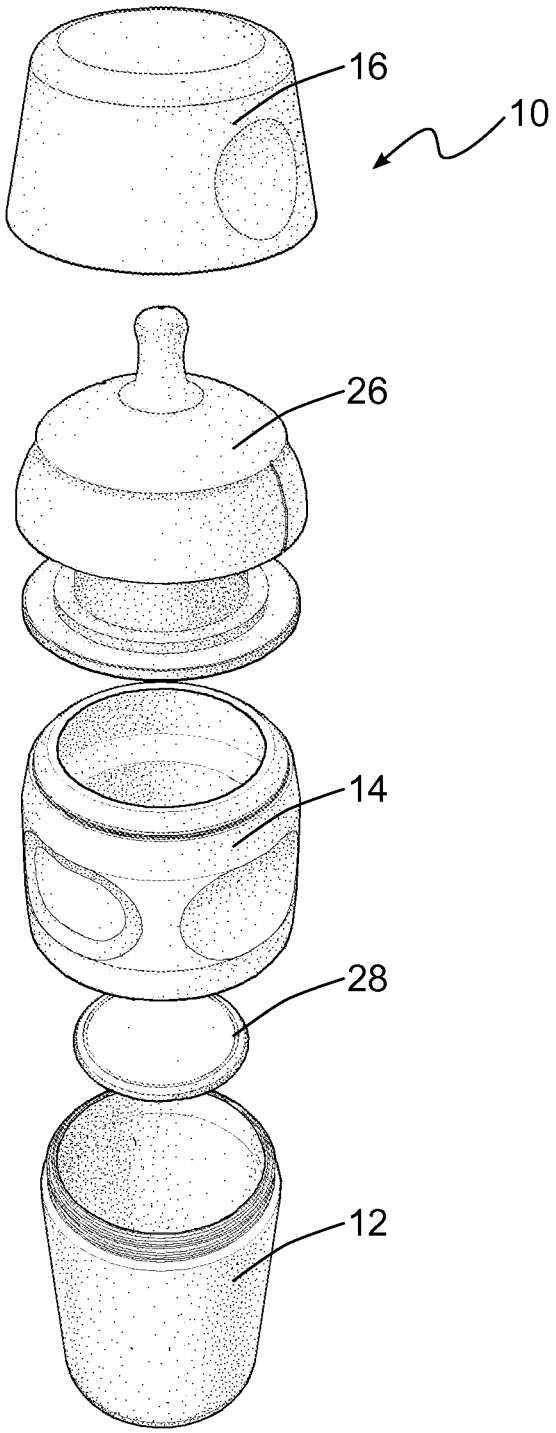
FIG. 2 is an exploded perspective view of the baby bottle in accordance with the invention.

FIG. 2 is an exploded perspective view of one embodiment of the baby bottle 10 in accordance with the invention. The five components of the baby bottle 10 are: the bottle 12; the collar 14; the cap 16; a nipple 26; and a seal plate 28.

The bottle 12 may be made of glass, food grade stainless steel, food grade silicone, or a rigid food grade polymer suitable for injection, tumble or blow molding, such as a high density polyethylene. A body of the collar 14 may be made of a rigid food grade polymer and contains other components and materials described below with reference to FIGS. 3-12. The cap 16 may be made of a semi-rigid food grade polymer. The nipple 26 may be made of food grade silicone, food grade rubber, or a neodymium catalyzed polyisoprene resin to provide a pliable nipple that simulates human skin. The seal plate 28 may be made of a combination of materials including food grade silicone, rigid and/or pliable food grade polymer, and food grade injection moldable thermoplastic resin (further details provided with reference to FIGS. 3-12).

As seen in FIG. 2, the components of the baby bottle 10 are assembled as follows: the nipple 26 is inserted into and is supported by the collar 14 (see FIGS. 3-12); the cap 16 is received and held in place by the collar 14 (see FIGS. 3-7 and FIGS. 9-12); the seal plate 28 is inserted into the nipple 26, which is supported by the collar 14 (see FIG. 4); and the collar 14 is screwed onto the bottle 12 (see FIGS. 5-12).

Figure 3:
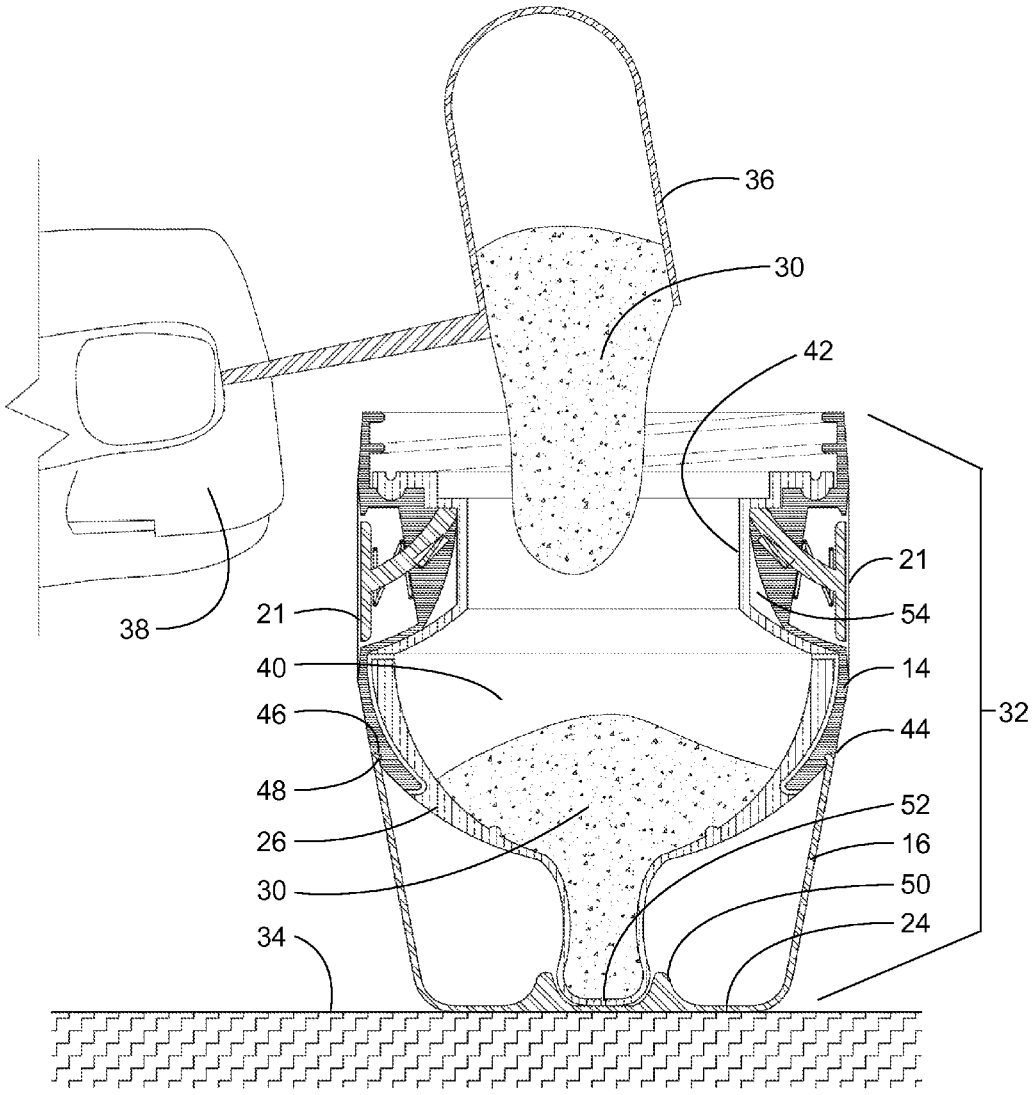
FIG. 3 is a schematic cross-sectional view, illustrating the loading of baby formula powder into the nipple, collar, and cap baby bottle assembly, taken along lines 5-5 of the baby bottle shown in FIG. 1.

FIG. 3 is a schematic cross-sectional view taken along lines 5-5 of FIG. 1, illustrating the loading of baby formula powder 30 into the nipple cavity 40. The nipple 26, collar 14, and cap 16 are assembled and hereinafter referred to simply as upper bottle 32. The upper bottle 32 is placed upside down on a horizontal surface 34 and maintained upright by the flat top 24 of the cap 16 without any need to further stabilize the upper bottle 32. Baby formula powder 30 is poured from a scoop 36, commonly supplied for that purpose, by a user's hand 38 until a recommended amount of baby formula powder 30 has been placed in the nipple cavity 40. The recommended amount of baby formula powder 30 is specified by the manufacturer of the baby formula powder 30. The nipple cavity 40 preferably has a volume adequate to store enough baby formula powder 30 to prepare a 9 ounce serving of baby formula. The open end of the nipple 26 has a wide mouth 42 which facilitates placing baby formula powder 30 in the nipple cavity 40.

As seen in FIG. 3, the cap 16 is flush at an outer bottom edge 44 with an outer surface of the collar 14. An annular groove 46 formed in the collar 14 accepts a corresponding annular ridge 48 on the bottom end of the cap 16 to secure the cap 16 to the collar 14. The cap 16 covers the nipple 26 to keep the nipple 26 in a hygienic condition prior to use. The cap 16 has an integrated cylindrical ridge 50 which lightly compresses the pierced nipple end 52, thereby effectively preventing fluid or baby formula powder 30 from escaping through the pierced nipple end 52. In one embodiment, the cap 16 is pliable enough to snap on and off of the collar 14, but rigid enough to protect the nipple 26 from impact while the cap 16 is on the baby bottle 10. The interior shape of the collar 14 matches the portion of exterior shape of the nipple 26 which it contacts, thereby providing support to the nipple 26. A void 54 between the collar 14 and the nipple 26, which extends around the entire circumference of the collar 14 and nipple 26, provides space for the nipple to distort when pressure is applied to the buttons 21, as will be explained below with reference to FIG. 7.

Figure 4:
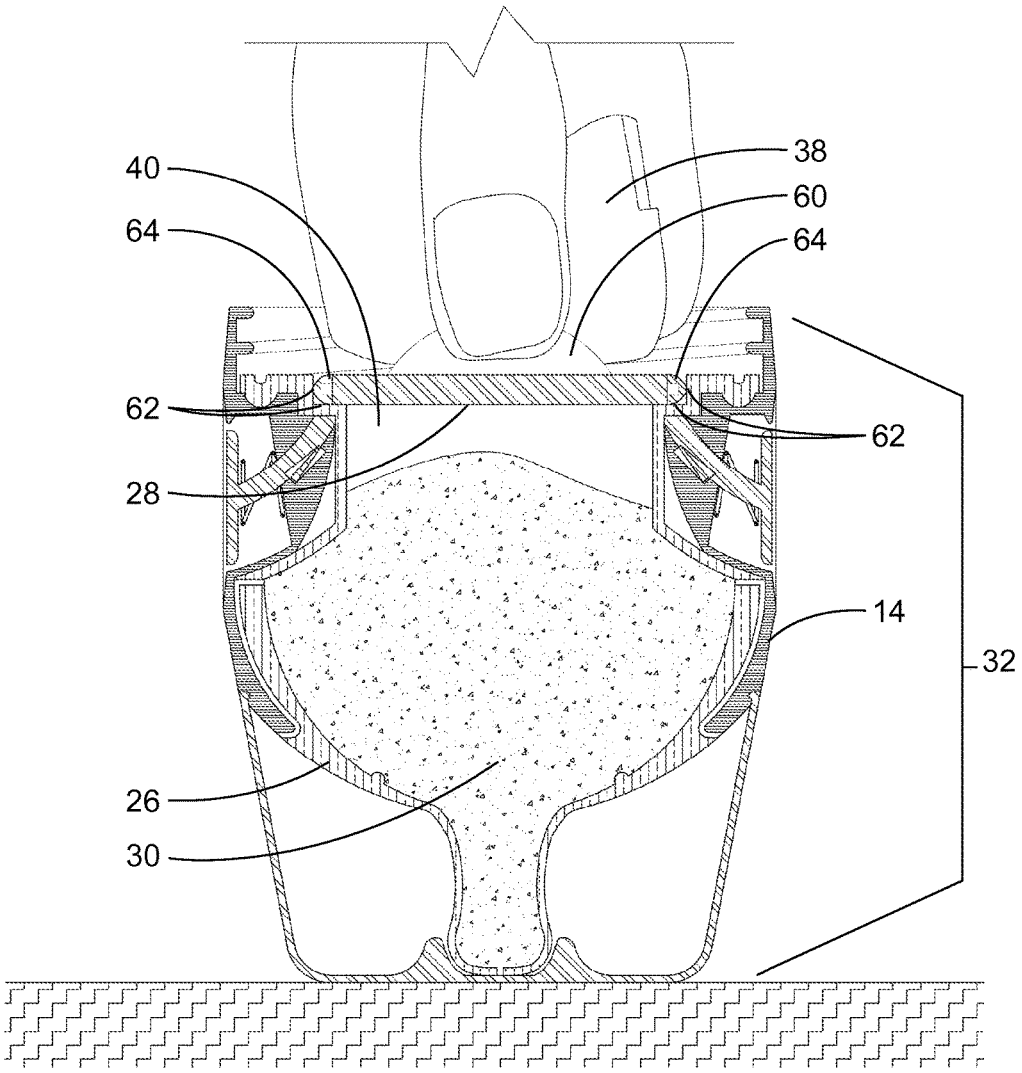
FIG. 4 is a schematic cross-sectional view, illustrating the sealing of the baby formula powder in the nipple cavity, taken along lines 5-5 of the baby bottle shown in FIG. 1.

FIG. 4 is a schematic cross-sectional view, illustrating the sealing of the baby formula powder 30 in the nipple cavity 40, taken along lines 5-5 of the baby bottle 10 shown in FIG. 1. In this embodiment, the seal plate 28 is a flat rigid disc-shaped body with a seal plate tab 60 that extends perpendicularly from one side of the seal plate 28. Typically, the user's hand 38 grips the seal plate tab 60 to insert the seal plate 28 into the seal recess 62 formed by the nipple 26, which is backed and supported by the collar 14. The peripheral edge of the seal plate 28 is provided with a pliable seal lip 64 which extends around a circumference of the seal plate 28. The pliable seal lip 64 is designed to compress and frictionally engage with the seal recess 62 thereby providing a fluid and air tight seal around the circumference of the seal recess 62 and preventing baby formula powder 30 from escaping the nipple cavity 40, and inhibiting fluid from entering the nipple cavity 40. Furthermore, the frictional resistance provided by the engagement of the seal lip 64 with the seal recess 62 is greater than the force applied by the baby formula powder 30 to the seal plate 28 when the upper bottle 32 is turned over and when the upper bottle 32 is dropped from the average height of a counter top, thereby preventing the seal plate 28 from dislodging and the baby formula powder 30 from escaping the nipple cavity 40.

Figure 5:
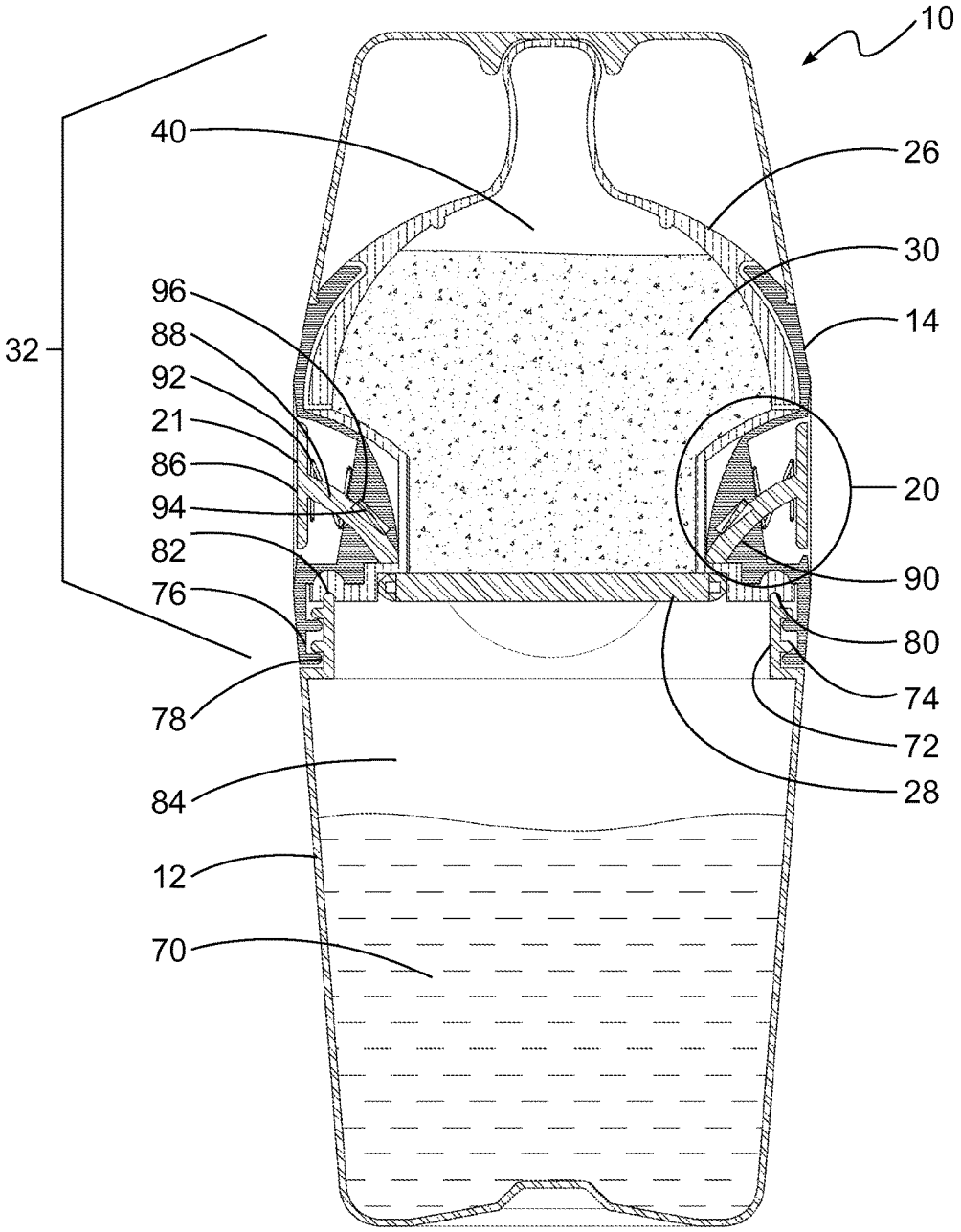
FIG. 5 is a schematic cross-sectional view, of the baby bottle separately holding baby formula powder and water, taken along lines 5-5 of the baby bottle shown in FIG. 1.
Figure 7:
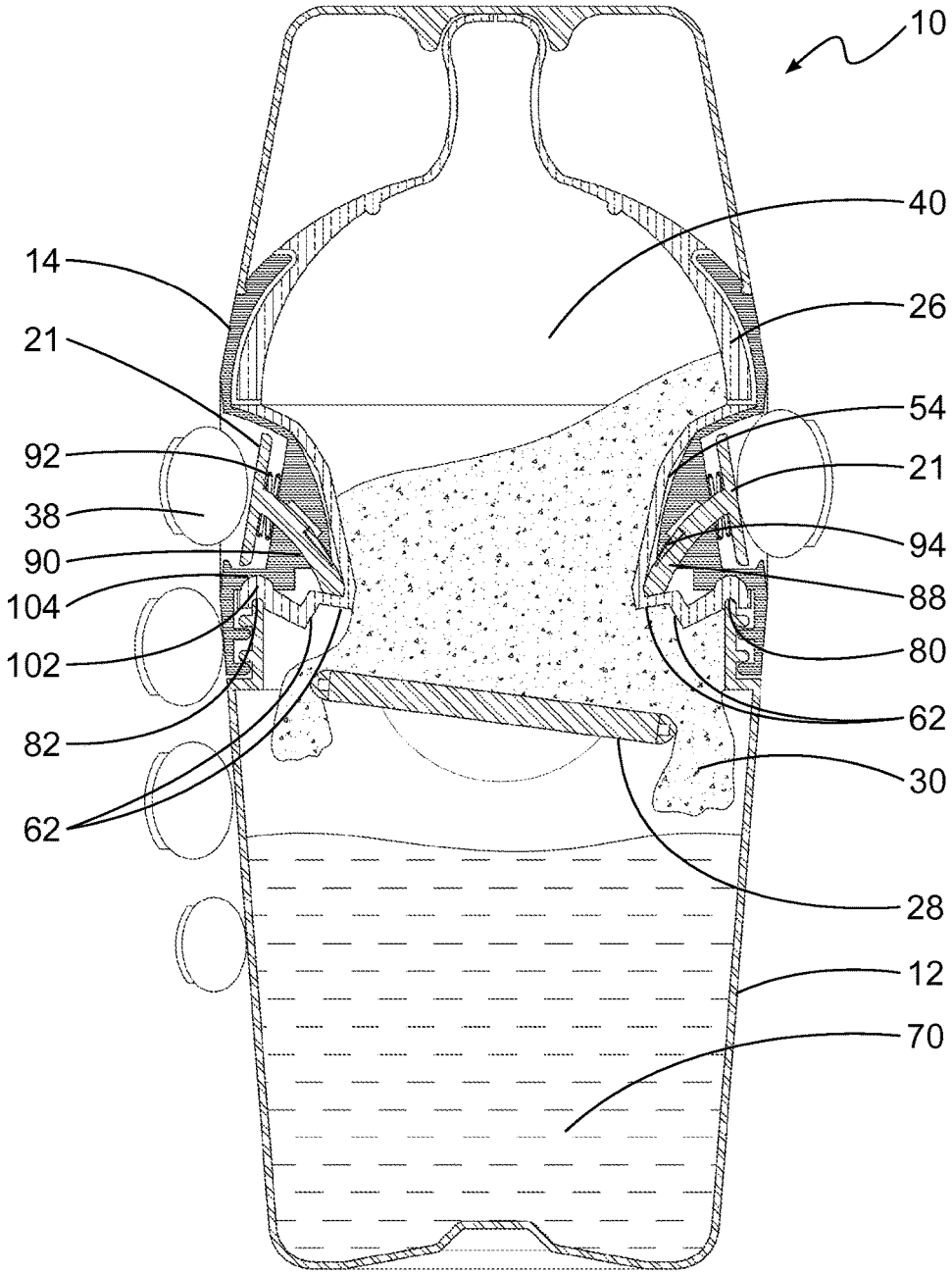
FIG. 7 is a schematic cross-sectional view, of baby formula powder being released from the nipple cavity of the baby bottle to prepare baby formula for consumption, taken along lines 5-5 of the baby bottle shown in FIG. 1.

FIG. 5 is a schematic cross-sectional view taken along lines 5-5 shown in FIG. 1, of the baby bottle 10 storing the baby formula powder 30 separate from a formula preparation fluid, such as water 70. After the upper bottle 32 is loaded with the required amount of baby formula powder 30 as described above with reference to FIG. 4 and the bottle 12 has been loaded with the required volume of fluid 70, the upper bottle 32 is secured to the bottle 12 by screwing the two together. The bottle 12 has a wide mouth 72 and external threads 74. The collar 14 has a bottom opening 76 which is nominally larger that the bottle 12 wide mouth 72 and which has internal threads 78 which engage with the bottle 12 external threads 74 when the upper bottle 32 is screwed to the bottle 12. A lip 80 of the bottle 12 compresses a corresponding annular groove 82 in the nipple 26 to provide a fluid seal between the bottle 12 and the upper bottle 32. Furthermore, the nipple 26 is compressed against the collar 14 thereby creating a fluid and air tight seal between the bottle 12 interior 84 and atmosphere. As explained above, the seal plate 28 provides a fluid and air tight seal between the bottle 12 interior 84 and the baby formula powder 30 held in the nipple cavity 40. Opposing seal plate release mechanisms 20 are integrated into the collar 14. Each seal plate release mechanism includes a button 21 with a curved surface 86 that conforms to the annular surface of the surrounding collar 14. The button 21 is connected to an arched shaft 88 which extends through a similarly shaped arched passage 90 in the collar 14 to contact an exterior surface of the nipple 26. A compression spring 92 urges each button 21 outwardly away from the collar 14 and maintains each button 21 in a normal position flush with the annular surface of the surrounding collar 14. A stopper element 94 of the arched shaft 88 permits the insertion of the arched shaft 88 into the arched passage 90 and further permits an inward and downward movement of the arched shaft 88 when manual pressure is applied to the button 21 (as shown in FIG. 7). The stopper element 94 also prevents the button 21 from moving beyond the normal position maintained by the compression spring 92 by engaging a stopper surface 96 formed in the arched passage 90 of the collar 14.

As seen in FIG. 5 the bottle 12 stores fluid, typically water 70. The bottle 12 has a nominal capacity of 9 ounces (266.2 ml) of fluid, though other sizes may be manufactured, such as a bottle 12 with a nominal capacity of 8 ounces (236.6 ml) of fluid, a bottle 12 with a nominal capacity of 5 ounces (147.9 ml) of fluid, and a bottle 12 with a nominal capacity of 4 ounces (118.3 ml) of fluid.

Figure 6:
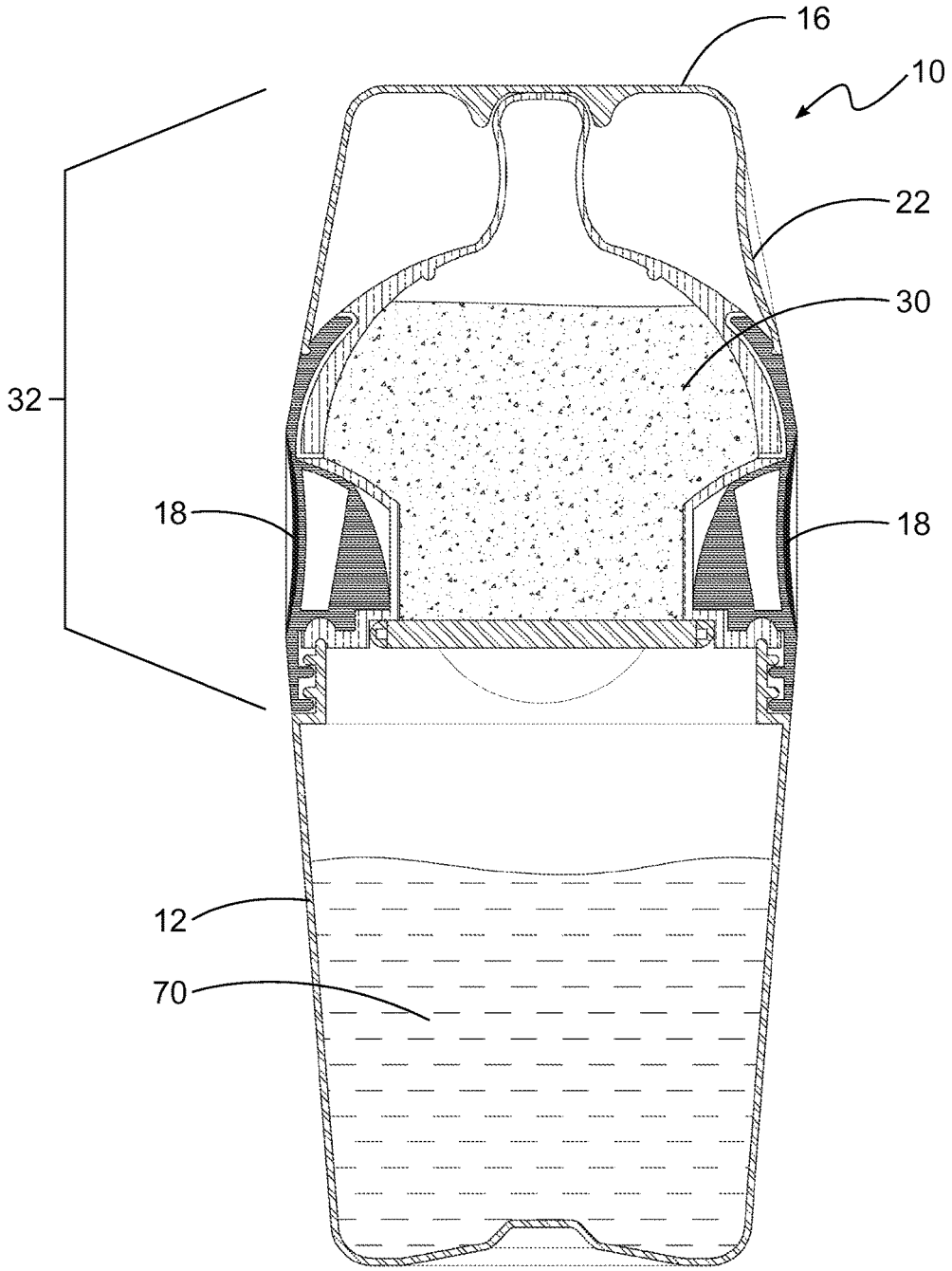
FIG. 6 is a schematic cross-sectional view, of the baby bottle separately holding baby formula powder and water, taken along lines 7-7 of the baby bottle shown in FIG. 1.

FIG. 6 is a schematic cross-sectional view taken along lines 7-7 shown in FIG. 1, of the baby bottle 10 separately holding baby formula powder 30 and fluid 70. Opposing grips 18, may be made of a food grade silicone, food grade injection moldable thermoplastic resin, or pliable food grade polymer. Opposing grips 18 aid the user when holding the baby bottle 10, removing the bottle 12 from the upper bottle 32, and removing the cap 16 from the baby bottle 10. The cap 16 has a concave surface 22 to provide improved manual leverage when removing the cap 16 from the baby bottle 10.

FIG. 7 is a schematic cross-sectional view taken along lines 5-5 of the baby bottle 10 shown in FIG. 1 of baby formula powder 30 being released from the nipple cavity 40 of the baby bottle 10 to prepare baby formula. The user squeezes opposing buttons 21 with the digits of their hand 38. The resulting compressive force on the buttons 21 compresses the springs 92 to move the arched shafts 88 downwardly through the arched passages 90 and into the portion of the nipple 26 which forms the seal recess 62. The stopper elements 94 of the arched shafts 88, fold into the arched shafts 88 as the buttons 21 are squeezed. The downward movement of the seal recess 62 dislodges the seal plate 28. The seal plate 28 and the baby powder formula 30 then fall into the fluid such as water 70. Shaking the bottle 10 mixes the baby formula powder 30 and fluid 70, during which time the seal plate 28 acts as an agitator to further aid the mixing process.

As seen in FIG. 7, the void 54 (referenced in FIG. 3 in its undistorted condition) between the collar 14 and the nipple 26, which extends the entire circumference of the collar 14 and nipple 26, allows the nipple 26 to distort when opposing buttons 21 are squeezed. Furthermore, the lip 80 of the bottle 12, which engages the corresponding annular groove 82 in the nipple 26, compresses a larger nipple lip 102 against a corresponding annular groove 104 in the collar 14, thereby maintaining a fluid tight seal between the bottle 12 and atmosphere when the seal plate 28 is released.

Figure 8:
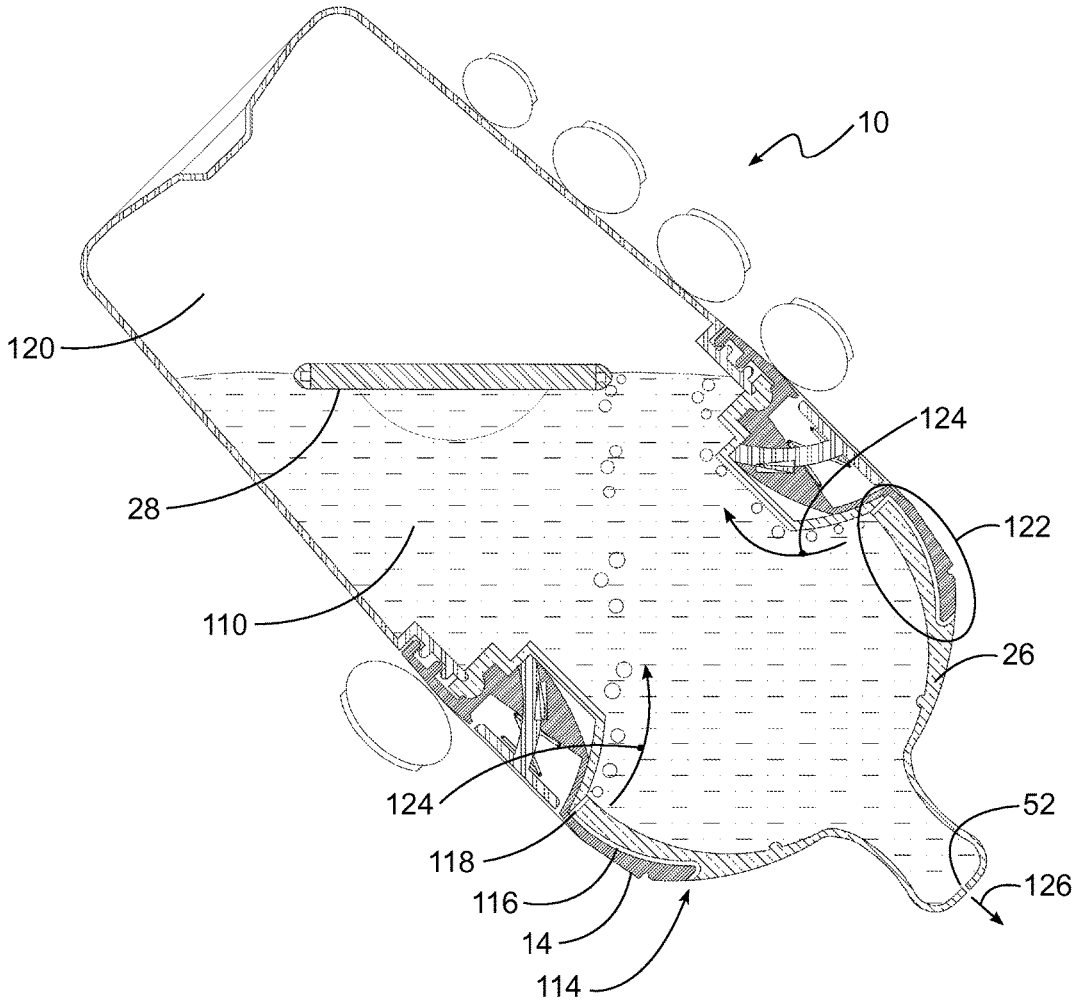
FIG. 8 is a schematic cross-sectional view, of the baby bottle in use during a feeding session, taken along lines 5-5 of the baby bottle shown in FIG. 1.

FIG. 8 is a schematic cross-sectional view, taken along lines 5-5 shown in FIG. 1, of the baby bottle 10 in use during a feeding session. When the baby bottle 10 is in a feeding position, the seal plate 28, having a density of less than 1, floats to the top of the mixed formula 110, so it does not interfere with the withdrawal of the mixed formula 110 from the baby bottle 10. As the mixed formula 110 is withdrawn 126 from the baby bottle 10 by a feeding infant, a vacuum is generated within the baby bottle 10. The vacuum induces an ingress of air 114 through a vent system 122, which includes a peripheral groove 116 on the outer face of the nipple 26 that is normally sealed by contact with the smooth inner surface of the collar 14. A tubular passage 118 connects the annular groove 116 with the inner volume 120 of the baby bottle 10 to complete the vent system 122. The ingress of air 114 creates bubbles 124 that rise through the mixed formula 110 at some distance from the pierced nipple end 52. The vent systems 122 inhibit fluid egress from the baby bottle 10 through the vent systems 122, but permit air ingress 114 when suction on the nipple creates sufficient vacuum within the baby bottle 10. This ensures a steady flow of mixed formula 126 through the pierced nipple end 52 and helps ensure that the feeding infant does not ingest air during feeding. In one embodiment, at least two vent systems 122 are provided on opposite sides of the nipple 26, as shown in FIG. 8.

After use the baby bottle 10 is easily cleaned since there are only 5 parts. Additionally, none of the parts exposed to baby formula have threads or other interstices where formula residue can accumulate and the exposed parts all have wide openings which facilitates cleaning.

Figure 9:
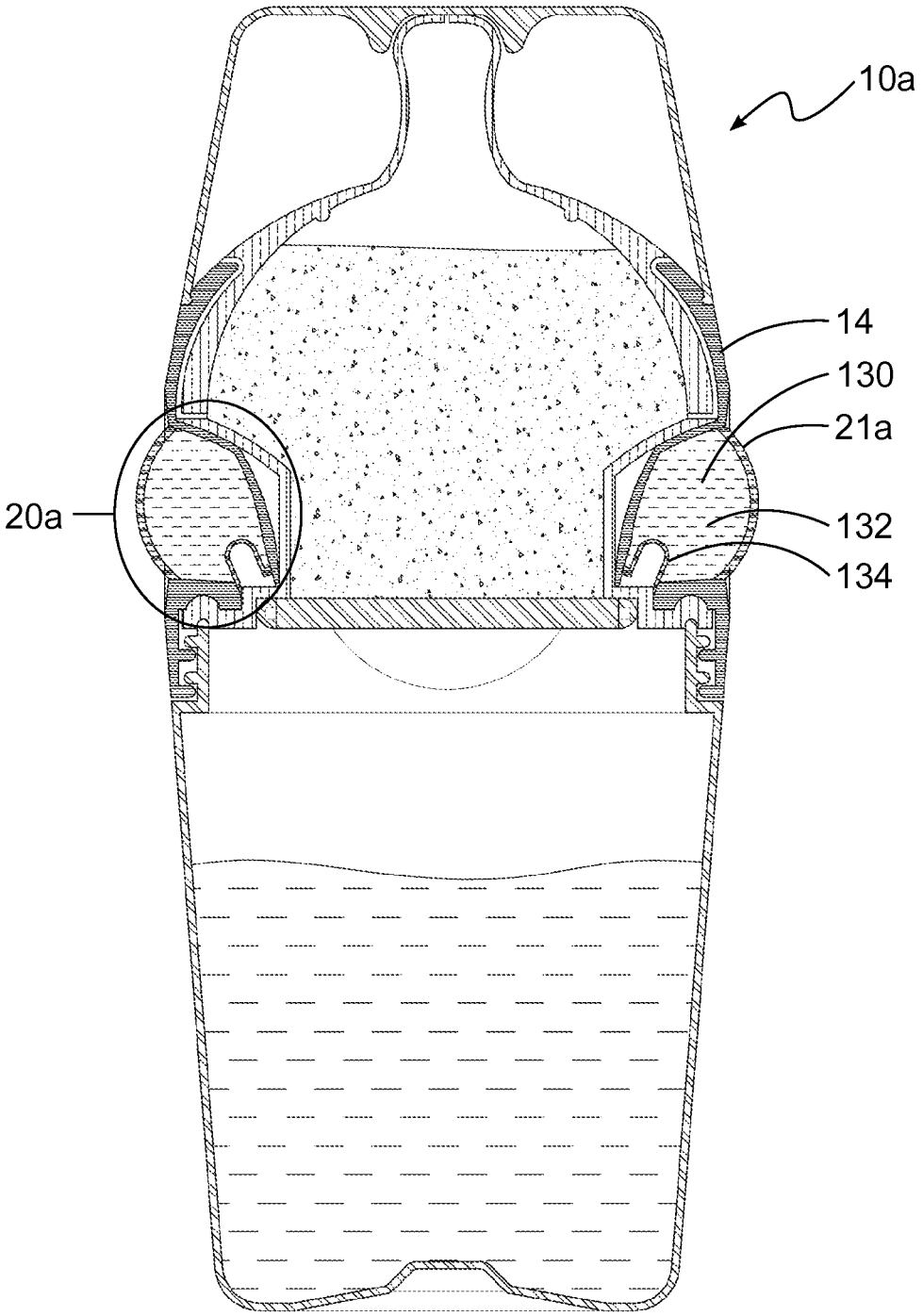
FIG. 9 is a schematic cross-sectional view of another embodiment of seal plate release mechanisms for the baby bottle in accordance with the invention, taken along lines 5-5 of the baby bottle shown in FIG. 1.

FIG. 9 is a schematic cross-sectional view, taken along lines 5-5 shown in FIG. 1, of another embodiment of a baby bottle **10*a* having seal plate release mechanisms 20*a* incorporated in the collar 14. Exposed button surfaces 21*a* are integrated into the collar 14. The exposed button surfaces 21*a* are a pliable waterproof and airtight polymer. A waterproof and airtight chamber 130 is filled with a fluid or gas 132. A waterproof and airtight pliable trigger mechanism 134 normally extends inwardly from the bottom of the chamber 130. The button surfaces 21*a* have elastic memory and are less pliable than the trigger mechanism 134**.

Figure 10:
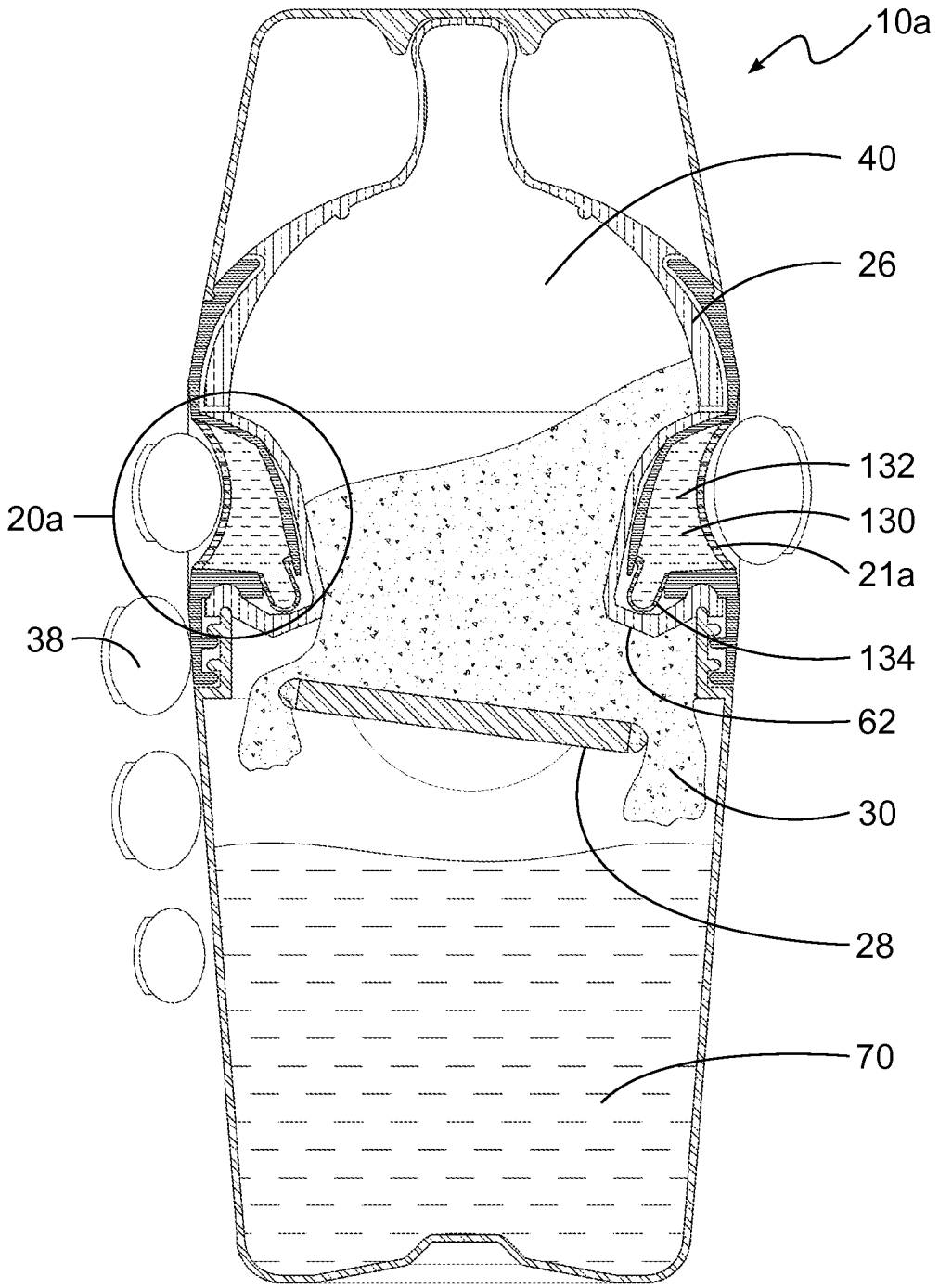
FIG. 10 is a schematic cross-sectional view of baby formula powder being released from the nipple cavity of the baby bottle of the embodiment of the invention shown in FIG. 9.

FIG. 10 is a schematic cross-sectional view of baby formula powder 30 being released from the nipple cavity 40 of the baby bottle **10*a* shown in FIG. 9. The user squeezes the exposed button surfaces 21*a* with the digits of their hand 38. The resulting compressive force on the exposed button surfaces 21*a* compresses the fluid or gas 132 in the waterproof and airtight chamber 130, which in turn distends the trigger mechanism 134, thereby forcing down the portion of the nipple 26 which forms the seal recess 62 shown in FIG. 9. The downward movement of the seal recess 62 dislodges the seal plate 28. The seal plate 28 and the baby formula powder 30 then fall into the fluid 70. When the button surfaces 21*a* are released, their elastic memory returns them to the shape shown in FIG. 9, and the trigger mechanism 134 is withdrawn into its normal configuration within the chamber 130. The action of shaking the bottle 10***a* mixes the baby formula powder 30 and the fluid 70, during which time the seal plate 28 acts as an agitator and further aids in mixing, as explained above.

Figure 11:
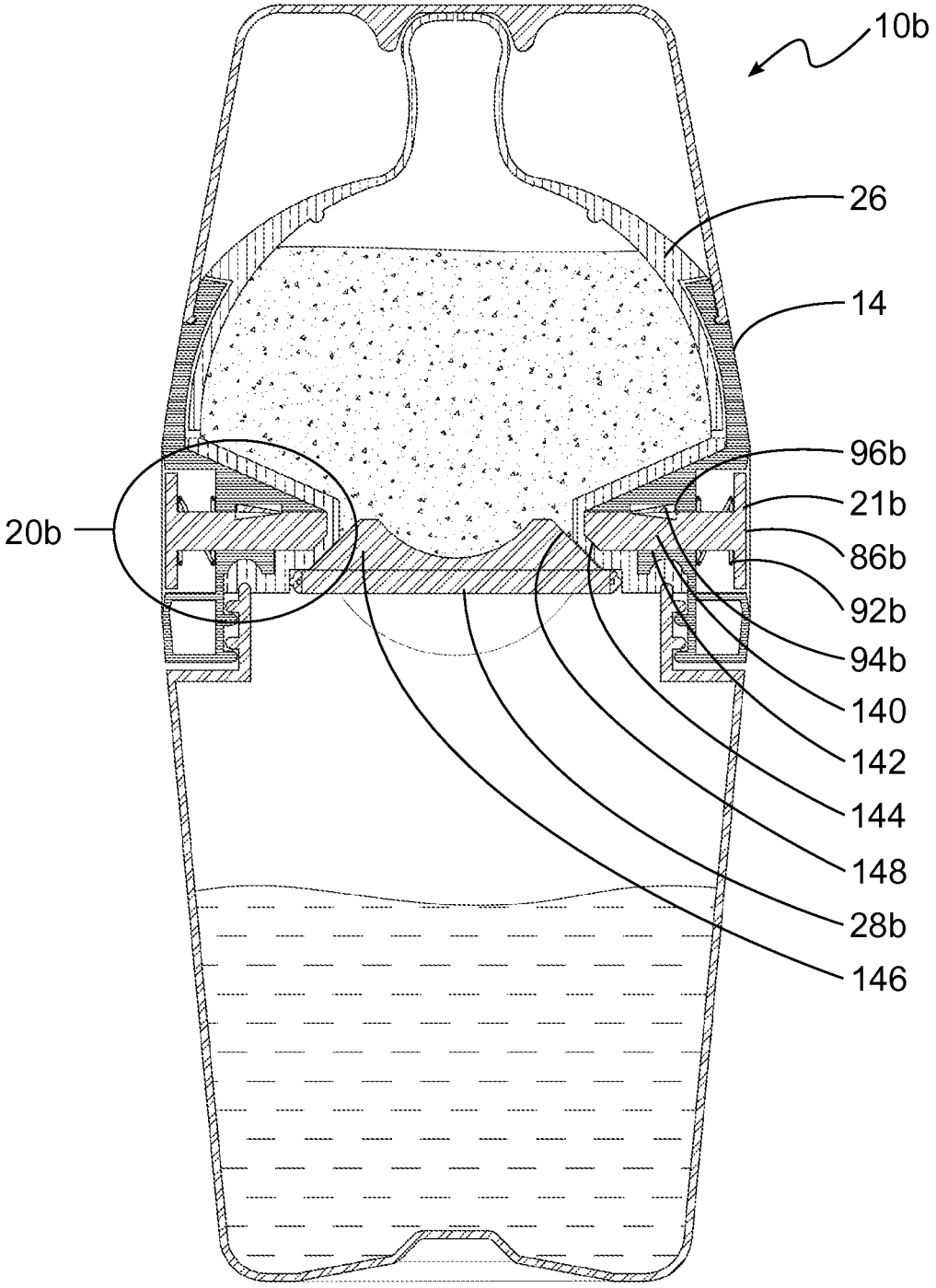
FIG. 11 is a schematic cross-sectional view of another embodiment of seal plate release mechanisms for the baby bottle in accordance with the invention, taken along lines 5-5 of the baby bottle shown in FIG. 1.
Figure 12:
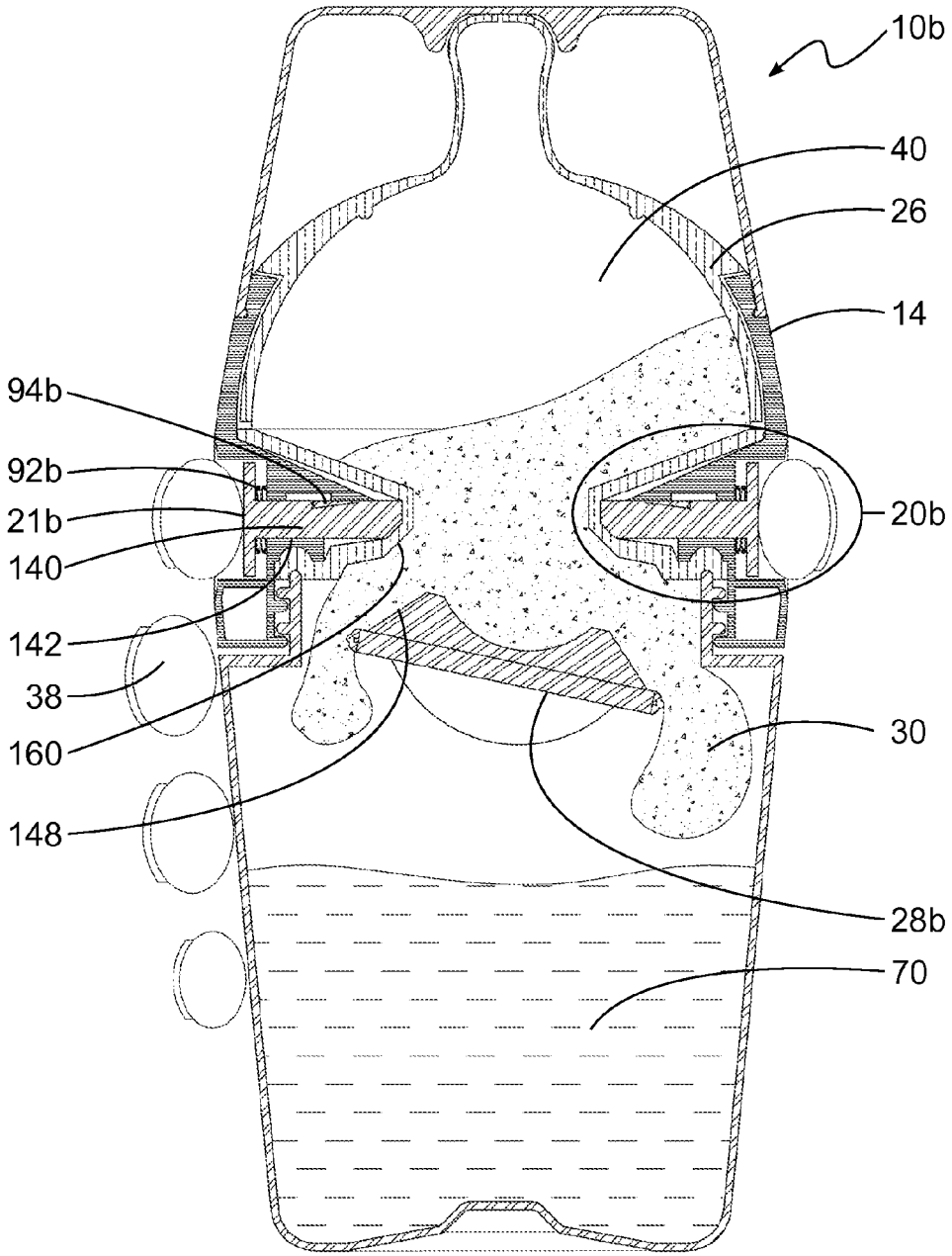
FIG. 12 is a schematic cross-sectional view of baby formula powder being released from the nipple cavity of the baby bottle of the embodiment of the invention shown in FIG. 11.

FIG. 11 is a schematic cross-sectional view of another embodiment of a baby bottle 10*b* having a seal plate release mechanism 20*b* taken along lines 5-5 of the baby bottle 10 shown in FIG. 1. Opposing seal plate release mechanisms 20*b* are integrated into the collar 14. Each seal plate release mechanism 20*b* includes a button 21*b* with a curved surface 86*b* which conforms with the annular surface of the surrounding collar 14 and one or more straight shafts 140, which extend through similar straight passages 142 in the collar 14 and contact the nipple 26. The end of the straight shaft 140 has an angled edge 144. A compression spring 92*b* urges the button 21*b* outwardly away from the collar 14. A stopper element 94*b* of the straight shaft 140: facilitates the insertion of the straight shaft 140 into the straight passage 142; permits inward movement of the straight shaft 140 when manual pressure is applied to the respective button 21*b* (as shown in FIG. 12); and prevents the button 21*b* from moving outwardly beyond the normal position by engaging with a stop 96*b* in the straight passage 142 in the collar 14. The seal plate 28*b* of this embodiment has a capped inverted cone shape 146 with a complimentarily angled edge 148 that abuts the nipple 14 and matches the angled edge 144 of the straight shaft 140.

FIG. 12 is a schematic cross-sectional view of baby formula powder 30 being released from the nipple cavity 40 of the baby bottle 10*b* shown in FIG. 11. The user squeezes opposing buttons 21*b* built into the collar 14 with the digits of their hand 38. The resulting compressive force on the buttons 21*b* compresses the springs 92*b* and moves the straight shafts 140 inwardly through the straight passages 142 and against the nipple 26. The stopper elements 94*b* of the straight shafts 140, fold into the straight shafts 140 as the buttons 21*b* are squeezed. A portion 160 of the nipple 26 is pushed towards the center of the baby bottle 10*b* and applies a resulting downward force against the inverted cone-shaped angled edge 148 of the seal plate 28*b*, thereby dislodging the seal plate 28*b*. The seal plate 28*b* and the baby formula powder 30 then fall into the fluid, such as water 70. Shaking the baby bottle 10*b* mixes the baby formula powder 30 and the fluid 70, during which time the seal plate 28*b* acts as an agitator and further aids in mixing.

It should also be noted that the baby bottles 10, 10*a*, and 10*b* are well suited for storing milk or pre-mixed formula in the bottle 12, and the baby bottles 10-10*b* will not leak while the seal plates 28, 28*b* are secured in the seal recess 62. The seal plates 28, 28*b* provide a fluid tight seal between the bottle 12 and atmosphere and segregate the vent systems 122 from the bottle 12, thereby preventing fluid from escaping the bottle 12 regardless of the position or movement of the baby bottles 10-10*b*.

Although the invention has been described with reference to various embodiments, the description provided and the embodiments shown are exemplary only. The scope of the invention is therefore to be limited solely by the scope of the appended claims.

I claim:

1. A baby bottle, comprising:

a bottle adapted to store a predetermined volume of fluid, the bottle having a top end with a wide mouth and an external thread around the wide mouth;

a nipple adapted to store a predetermined volume of baby formula powder for mixing with the fluid, the nipple having a bottom end adapted to cover the wide mouth of the bottle;

a collar element that accepts the nipple, the collar element having at least one seal plate release mechanism to release the stored baby formula powder into the stored fluid, and an internal thread designed to engage the bottle's external thread;

a seal plate adapted to be retained in a seal recess that is formed by the nipple and backed by the collar element, the seal plate providing a fluid resistant partition between the fluid and the baby formula powder; and a snap-on cap that attaches to the collar to keep an exposed portion of the nipple hygienic prior to use.

2. The baby bottle as claimed in claim 1 wherein the collar element comprises opposed seal plate release mechanisms.

3. The baby bottle as claimed in claim 1 wherein the snap-on cap comprises a flat top that supports the baby bottle in a stable inverted position.

4. The baby bottle as claimed in claim 1 wherein the nipple in combination with the collar comprises at least one integrated vent system that inhibits an egress of fluid from the baby bottle but permits an ingress of air when a vacuum is created within the baby bottle.

5. The baby bottle as claimed in claim 1 wherein the seal plate comprises a flat circular disc of high density food grade polymer, an edge of the seal plate comprises a flexible food grade polymer which forms a fluid tight nipple interface, and a grip tab which extends from one side of the disc.

6. The baby bottle as claimed in claim 1 wherein the at least one seal plate release mechanism comprises a spring loaded button connected to an arched shaft and an application of manual pressure to the button moves the arched shaft downwardly to displace the seal plate from the seal recess formed by the nipple, thereby releasing the stored baby formula powder into the stored fluid.

7. The baby bottle as claimed in claim 1 wherein the seal plate comprises a flat circular disc with one side of the flat disc comprising a capped inverted cone shape of food grade polymer, the edge of the seal plate comprises a flexible food grade polymer which forms a fluid resistant nipple interface, and a grip tab which extends from an opposite side of the disc.

8. The baby bottle as claimed in claim 1 wherein the at least one seal plate release mechanism comprises an airtight and waterproof chamber filled with a fluid or a gas, the chamber having an exposed surface comprising a pliable waterproof and airtight button and a pliable waterproof and airtight trigger mechanism at a bottom of the chamber, and applying manual pressure to the button displaces the fluid or a gas in the chamber and distends the pliable waterproof and airtight trigger mechanism downwardly, thereby releasing the seal plate from the seal recess of the nipple to release the stored baby formula powder into the stored fluid.

9. The baby bottle as claimed in claim 1 wherein the at least one seal plate release mechanism comprises a spring loaded button connected to a straight shaft and applying manual pressure to the button moves the straight shaft inwardly to displace the seal plate from the nipple, thereby releasing the stored baby formula powder into the stored fluid.

10. A baby bottle, comprising:

a bottle adapted to store a predetermined volume of fluid, the bottle having a wide mouth with an external thread around the wide mouth;

a nipple adapted to store a predetermined volume of baby formula powder for mixing with the fluid, the nipple having a bottom end adapted to cover the wide mouth of the bottle;

a collar element that accepts the nipple, the collar element having opposed seal plate release mechanisms adapted to release the stored baby formula powder into the stored fluid, and an internal thread adapted to engage the external thread of the bottle; and a seal plate adapted to be releasably retained within a seal plate recess of the nipple, the seal plate providing a fluid resistant partition between the fluid and the baby formula powder.

11. The baby bottle as claimed in claim 10 further comprising a snap-on cap that attaches to the collar to keep an exposed portion of the nipple hygienic prior to use, the snap of cap having a flat top surface that will support the baby bottle in a stable inverted position.

12. The baby bottle as claimed in claim 10 further comprising at least one vent system that inhibits an egress of fluid from the baby bottle while permitting an ingress of air into the bottle when a vacuum is created within the bottle.

13. The baby bottle as claimed in claim 10 wherein the at least one seal plate release mechanism comprises opposed buttons connected to arched shafts that are moved inwardly and downwardly by manual pressure on the respective buttons, and the inward and downward movement of the arched shafts exerts pressure on the nipple that dislodges the seal plate from the seal plate recess.

14. The baby bottle as claimed in claim 10 wherein the at least one seal plate release mechanism comprises opposed chambers in the collar element, the respective opposed chambers having respective exposed button surfaces and respective flexible trigger mechanisms that are respectively displaced by pressure on the respective exposed button surfaces, whereby displacement of the respective trigger mechanisms exerts pressure on the nipple to dislodge the seal plate from the seal plate recess.

15. The baby bottle as claimed in claim 10 wherein the at least one seal plate release mechanism comprises opposed buttons connected to straight shafts that are moved inwardly by manual pressure on the respective buttons, and the inward movement of the straight shafts exerts pressure on the nipple to dislodge the seal plate from the seal plate recess.

16. A baby bottle, comprising:

a bottle adapted to store a predetermined volume of fluid, the bottle having a wide mouth with an external thread around the wide mouth;

a nipple adapted to store a predetermined volume of baby formula powder for mixing with the fluid, the nipple having a bottom end adapted to cover the wide mouth of the bottle;

a collar element that accepts the nipple, the collar element having a seal plate release mechanism adapted to release the stored baby formula powder into the stored fluid, and an internal thread adapted to engage the external thread of the bottle;

a seal plate adapted to be releasably retained within a seal recess of the nipple, the seal plate providing a fluid resistant partition between the fluid and the baby formula powder; and at least one vent system that inhibits an egress of fluid from the bottle while permitting air to flow into the bottle when a vacuum is created within the bottle.

17. The baby bottle as claimed in claim 16 wherein the seal plate release mechanism comprises a button connected to a shaft and a spring to urge the button to a normal position in which the seal plate is retained in the seal recess, the spring permitting the button to be pressed inwardly to an extent that an inner end of the shaft contacts the nipple and releases the seal plate from the seal recess.

18. The baby bottle as claimed in claim 16 wherein the seal plate comprises a rigid disc with a pliable peripheral seal lip that provides a fluid resistant seal between the seal plate and the seal recess.

19. The baby bottle as claimed in claim 16 further comprising a snap-on cap that protects the nipple until the bottle is to be used for feeding.

20. The baby bottle as claimed in claim 16 wherein the seal plate release mechanism comprises a button connected to at least one shaft supporting the button in a normal position in which the seal plate is retained in the seal recess, the at least one shaft permitting the button to be pressed inwardly to an extent that an inner end of the shaft contacts the nipple and releases the seal plate from the seal recess.

* * * * *